US006672440B2

(12) United States Patent
Lin et al.

(10) Patent No.: US 6,672,440 B2
(45) Date of Patent: Jan. 6, 2004

(54) BEZEL OF LUGGAGE HANDLE

(75) Inventors: Jer Hong Lin, Taipei (TW); Boon Hwa Lau, Hsin Chuang (TW)

(73) Assignee: Chaw Khong Technology Co., Ltd., Taipei (TW)

( * ) Notice: Subject to any disclaimer, the term of this patent is extended or adjusted under 35 U.S.C. 154(b) by 0 days.

(21) Appl. No.: 10/179,182

(22) Filed: Jun. 26, 2002

(65) Prior Publication Data

US 2003/0000786 A1 Jan. 2, 2003

(30) Foreign Application Priority Data

Jun. 28, 2001 (TW) ..... 90210866

(51) Int. Cl.[7] ..... A45C 13/36; A45C 13/00
(52) U.S. Cl. ..... 190/115; 190/39; 16/113.1
(58) Field of Search ..... 190/115, 39; 16/113.1

(56) References Cited

U.S. PATENT DOCUMENTS 294,260 A * 2/1884 Niles ..... 190/39 X
5,566,798 A 10/1996 Tsai ..... 190/115
5,689,854 A * 11/1997 Wang ..... 190/115 X
5,690,196 A * 11/1997 Wang ..... 190/39 X
5,862,898 A * 1/1999 Chang ..... 190/39 X
6,079,527 A * 6/2000 Kuo ..... 190/115
6,148,478 A * 11/2000 Kuwayama ..... 16/113.1
2003/0000785 A1 * 1/2003 Miller et al.

FOREIGN PATENT DOCUMENTS

CN 387218 4/1989

* cited by examiner

*Primary Examiner*—Sue A. Weaver
(74) *Attorney, Agent, or Firm*—Troxell Law Office PLLC

(57) ABSTRACT

A bezel of luggage comprises a vertical portion, a horizontal portion, a first recess surrounded by the horizontal portion and the rear lower side, and a second recess surrounded by the front upper side and the vertical portion. This can protect fingers and thumb in the handle retracting process. This is because there is a sufficient space left between handle grip and second recess and between handle grip and first recess respectively when handle grip is fully retracted onto bezel.

4 Claims, 6 Drawing Sheets

BEZEL OF LUGGAGE HANDLE

BACKGROUND OF THE INVENTION

1. Field of the Invention

The present invention relates to handle of luggage and more particularly to a bezel luggage having a safety arrangement for preventing hand from being hurt in retracting handle.

2. Description of Related Art

A conventional wheeled luggage is always equipped with a retractable handle. Accordingly, a recessed bezel is a necessary element in luggage for receiving a retracted handle. In general, bezel is provided on the top rear portion of luggage. A great number of patents worldwide have been disclosed related to the improvement of bezel. For example, U.S. Pat. No. 5,566,798 to Tsai entitled "Trunk With A Concealable Retractable Handle" and Taiwanese Utility Model Publication No. 387,218 entitled "Bumping Prevented Device for Luggage Handle" both disclose a small recess for hand to insert into in addition to the large recess of bezel. The difference of them is that the small recess is located below the large recess in the former while an additional bumping prevented device further provided above the large recess in the latter. The purpose of small recess is for providing a passage for hand to insert into bezel to grip handle grip easily. However, in the former, the problem of hurting fingers in bezel while retracting handle has not been considered. Such may be best illustrated in FIGS. 1A and 1B. As shown in FIG. 1A, fingers F are safe before handle grip H is retracted into bezel R. However, as shown in FIG. 1B, when handle grip H is pushed down quickly thumb T is squeezed at the edge C between handle grip H and top of luggage. Since the pushing force is strong if the retracting of handle is quick thumb T tends to hurt in such case. To solve the problem mentioned above, the latter further provides an additional bumping prevented device 28 in the recess 27 which is located at upper portion of vertical wall of the bezel. However, the device 28 is made of sponge which tends to be easily worn after use for a period of time. Such may also have thumb T to hurt the upper edge or lower edge of the recess 27 of bezel as mentioned above. Thus, improvement exists.

SUMMARY OF THE INVENTION

It is an object of the present invention to provide a safe retractable handle system of luggage wherein an upper small recess is provided in a joint of vertical portion and upper front part of bezel and a lower small recess is provided in a joint of horizontal portion and lower rear part of bezel respectively. By configuring as this, hand of user may not be hurt in the process of retracting handle into bezel.

To achieve the above and other objects, the present invention provides a bezel on a top rear portion of a wheeled luggage including a retractable handle having two handle rods and a top handle grip, the bezel comprising a body including a front upper side, two-arcuate sides, and a rear lower side; a vertical portion; a horizontal portion; two spaced tunnels near sides of the horizontal portion sleeved on the handle rods of the handle; a first recess surrounded by the horizontal portion and the rear lower side for permitting fingers of user to insert in while the handle grip is fully retracted onto a space defined by the vertical and the horizontal portions; and a second recess surrounded by the front upper side and the vertical portion for permitting a thumb of user to insert in while the handle grip is fully retracted onto the space defined by the vertical and the horizontal portions. This can protect fingers and thumb in the retracting process.

The above and other objects, features and advantages of the present invention will become apparent from the following detailed description taken with the accompanying drawings.

DETAILED DESCRIPTION OF THE PREFERRED EMBODIMENTS

Figure 1B:
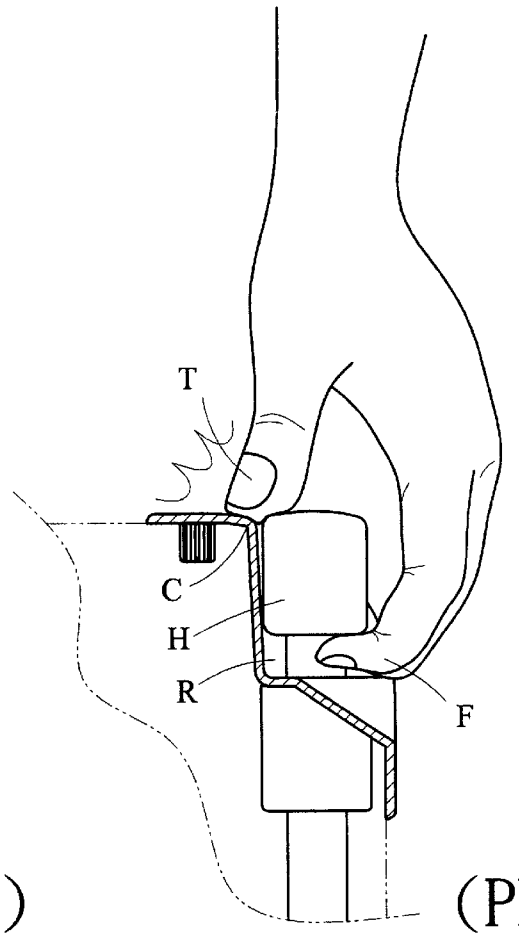
FIG. 1B (PRIOR ART)
FIG. 1B is a view similar to FIG. 1A, where handle is to be fully retracted.
Figure 1A:
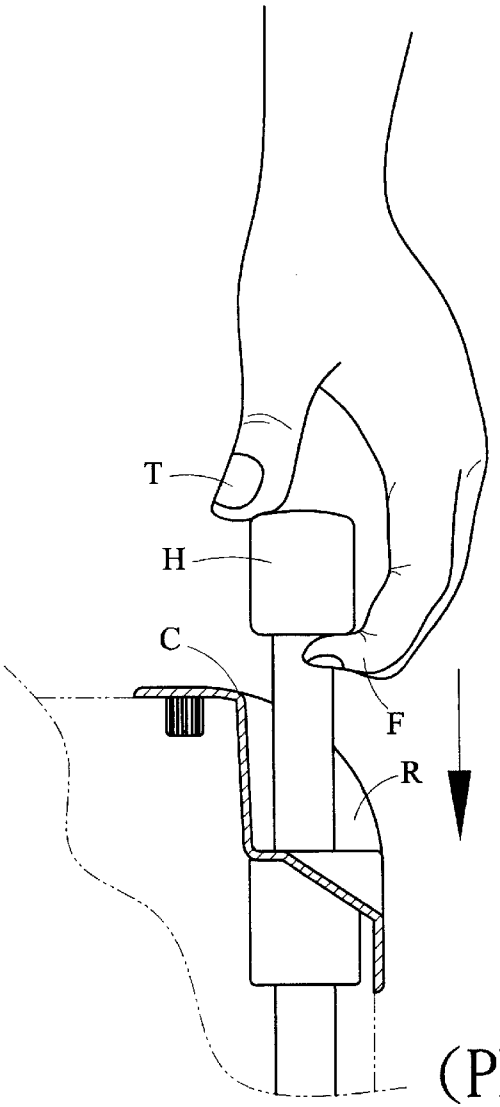
FIG. 1A (PRIOR ART)
FIG. 1A is a schematic cross-sectional view of bezel portion of a conventional luggage, where handle is not fully retracted.
Figure 2:
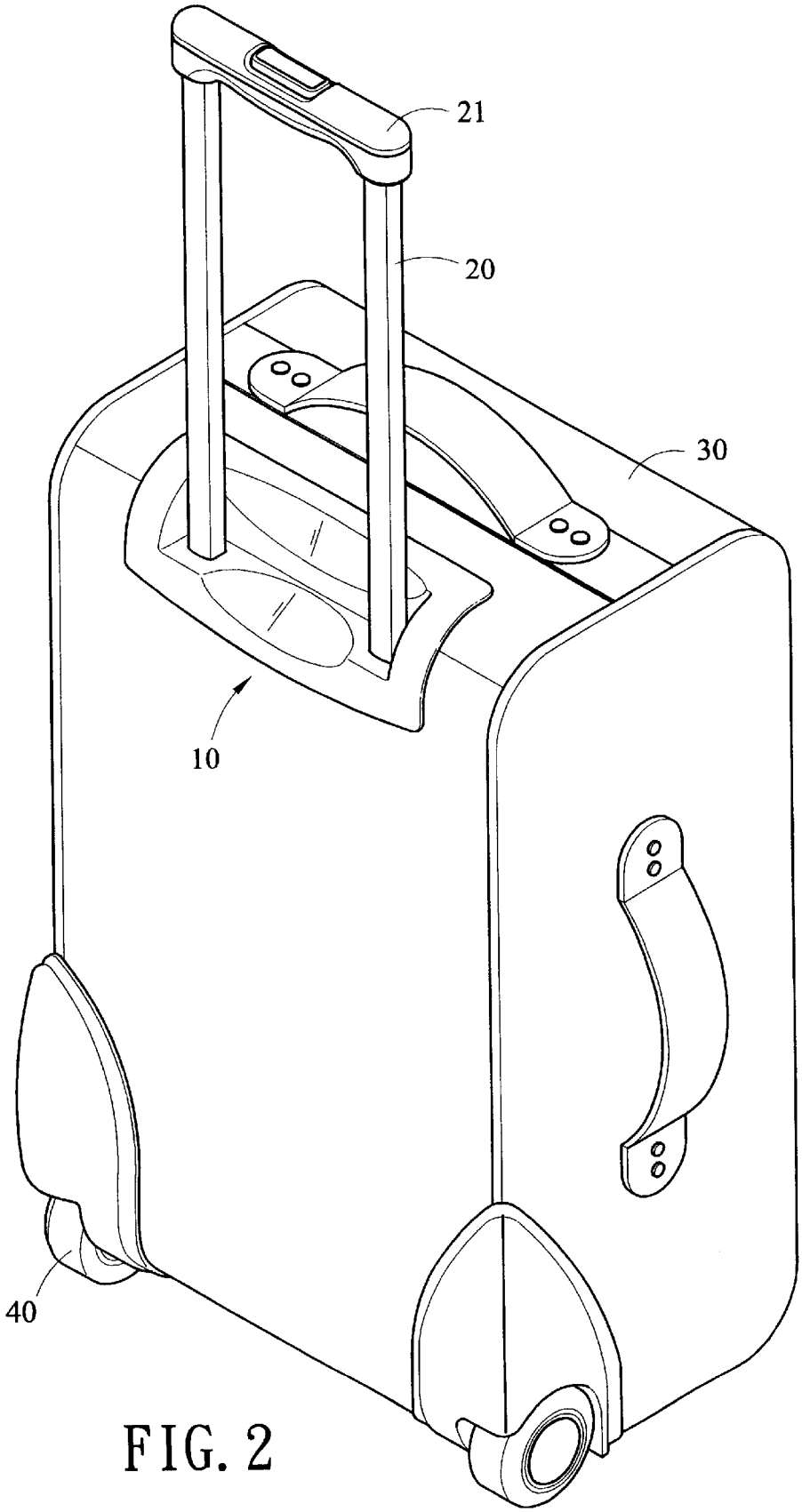
FIG. 2 is a perspective view of a first preferred embodiment of luggage incorporating a safe bezel according to the invention.
Figure 3B:
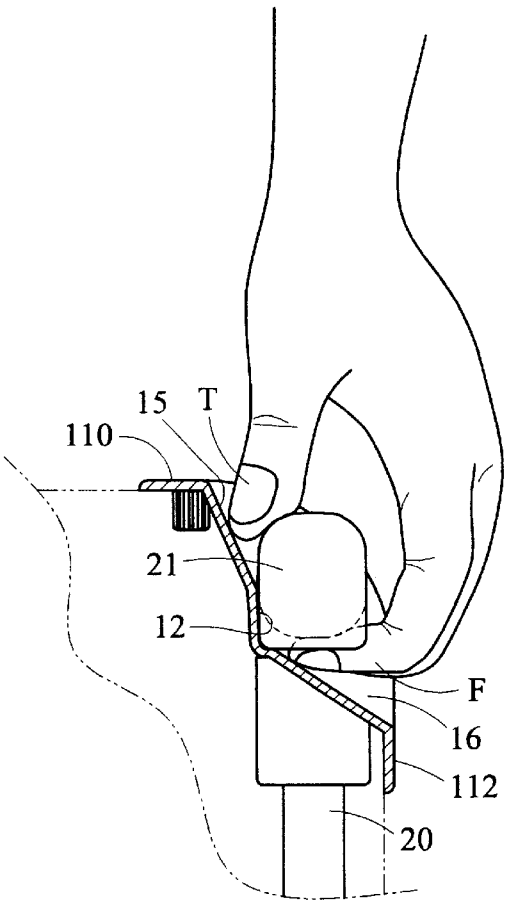
FIG. 3B is a view similar to FIG. 3A, where handle is fully retracted.
Figure 3A:
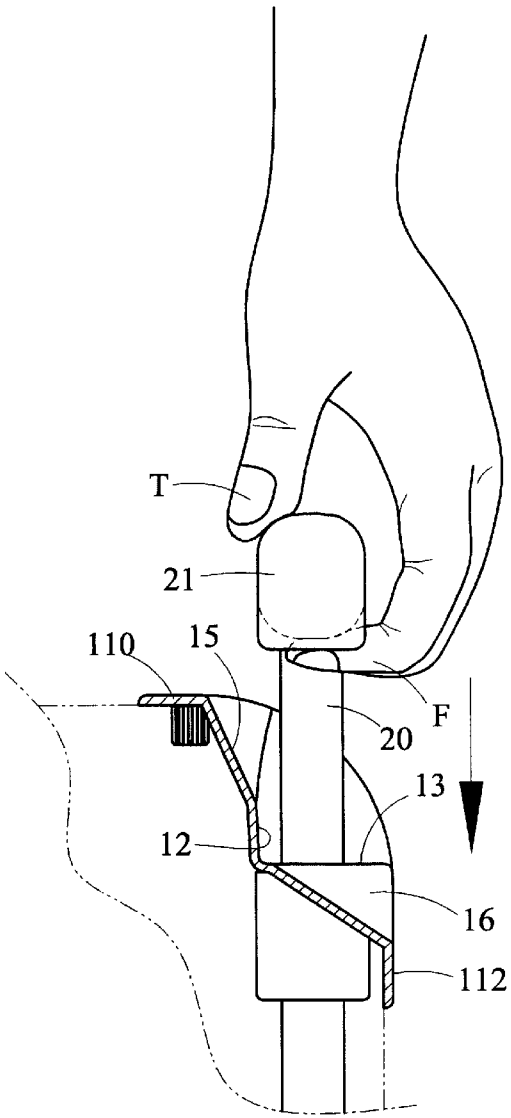
FIG. 3A is a schematic cross-sectional view of bezel portion of FIG. 2 luggage, where handle is not fully retracted.
Figure 4:
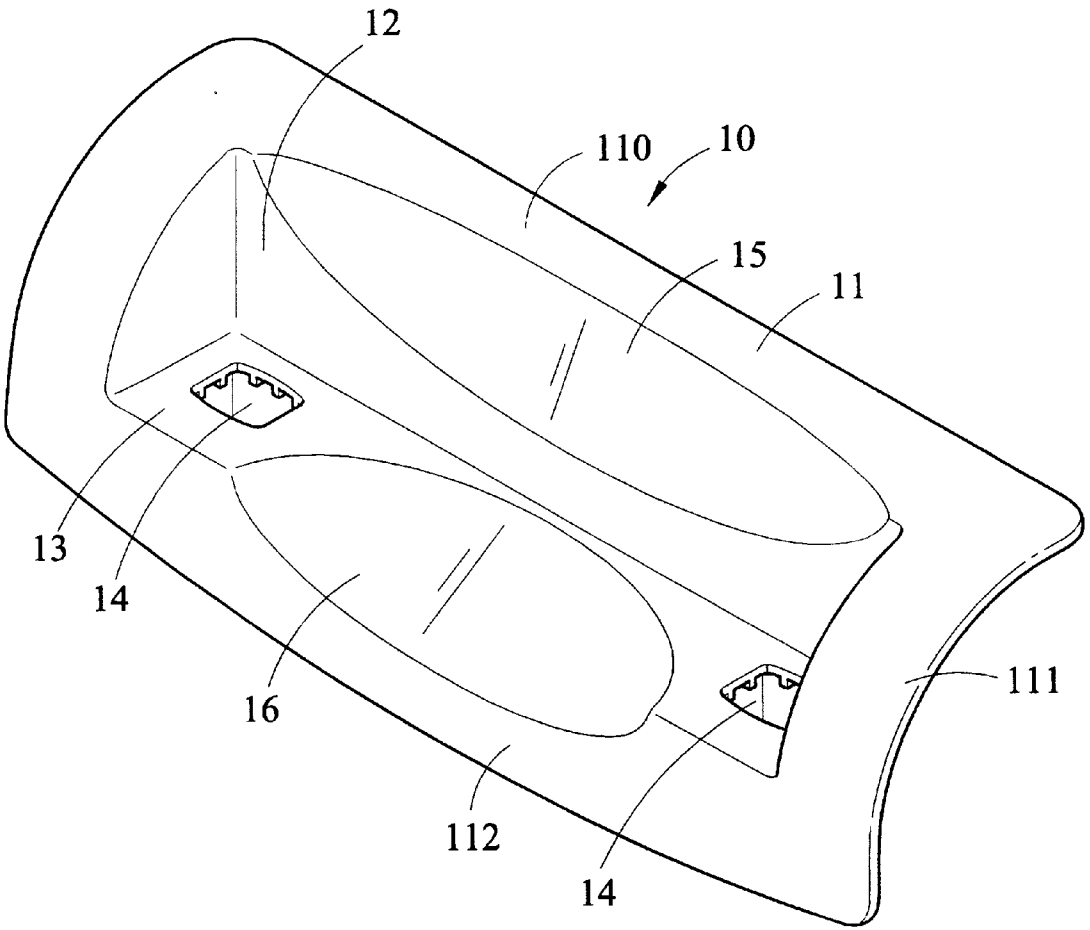
FIG. 4 is a perspective view of bezel shown in FIG. 2.

Referring to FIGS. 2 to 4, a description of a first embodiment of safe bezel of wheeled luggage in accordance with the invention will be detailed below. The luggage comprises a main body 30, a bezel 10 on the top rear portion of the body 30, a retractable handle 20 having a top handle grip 21, and two sets of wheels 40 on the rear bottom portion of the body 30.

As shown in FIG. 4 specifically, bezel 10 comprises a body 11 including a front upper side 110, two arcuate sides 111, and a rear lower side 112, a vertical portion 12, a horizontal portion 13, two spaced tunnels 14 near sides of horizontal portion 13 sleeved on two handle rods of handle 20, a first recess 16 surrounded by horizontal portion 13 and rear lower side 112, and a second recess 15 surrounded by front upper side 110 and vertical portion 12 wherein the latter two elements are the most important ones, i.e., the characteristics of the invention. The purpose of recesses 15 and 16 are for providing passages for hand to insert into bezel 10 to grip handle grip 21 easily while safely. As shown in FIG. 3A, fingers F and thumbs T are safe before pushing handle grip 21 down. Further, as shown in FIG. 3B, handle grip 21 gripped by fingers F and thumb T is pushed down safely and quickly until handle 20 is fully retracted onto a space defined by vertical portion 12 and horizontal portion 13. At this time, there is still a sufficient space left between handle grip 21 and second recess 15 and between handle grip 21 and first recess 16 respectively. Hence, fingers F and thumb T are protected. This eliminates the drawback of prior art of possibly hurting thumb T in above retracting process.

Referring to FIGS. 3A, 3B and 4, it is to be noted that to facilitate passage for hand to insert into the bezel to grip the handle grip easily, according to the first embodiment of the invention, the recesses 15 and 16 are a smooth curved shape.

The first recess 16 has a surface that is oriented obliquely relative to the horizontal portion 13 and the rear lower side 112. The second recess 15 has a surface that is oriented obliquely relative to the front upper side 110 and the vertical portion 12.

Figure 5:
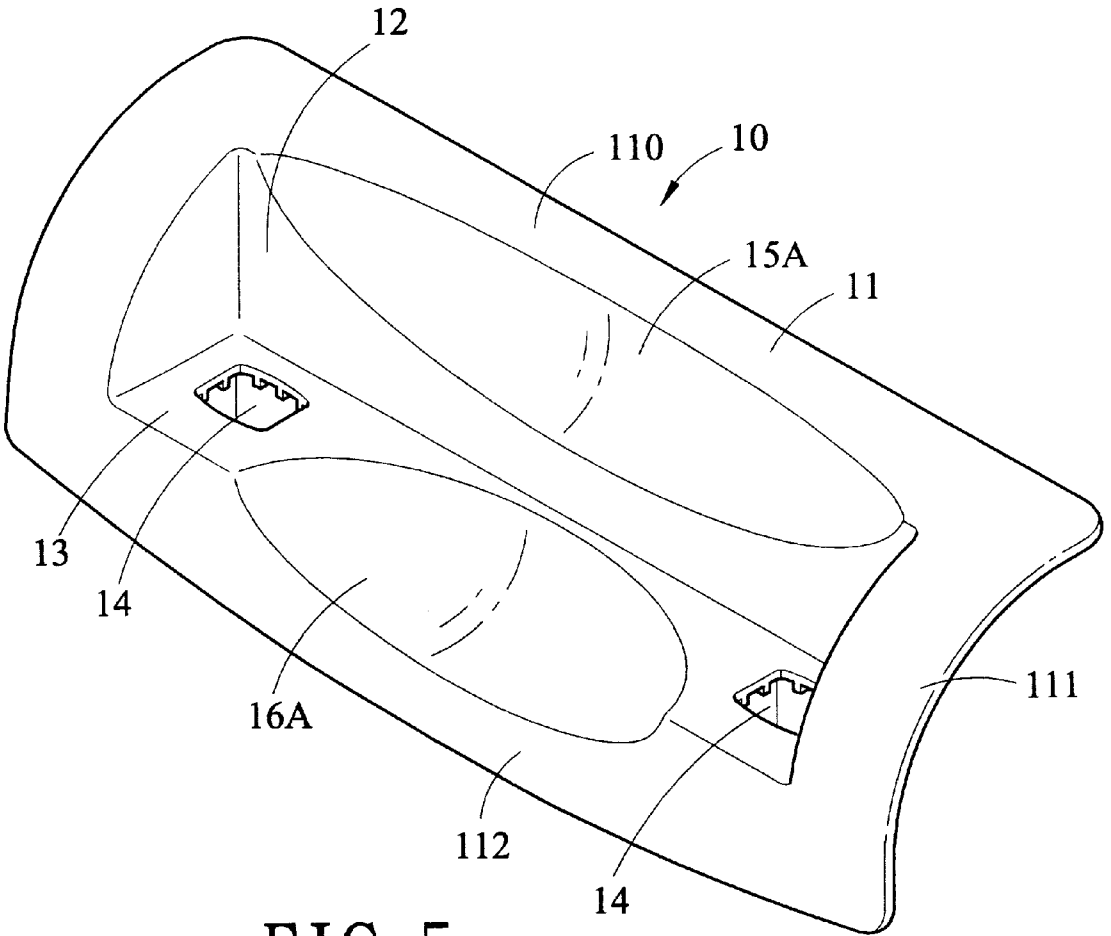
FIG. 5 is a perspective view of a second preferred embodiment of bezel of luggage according to the invention.
Figure 6:
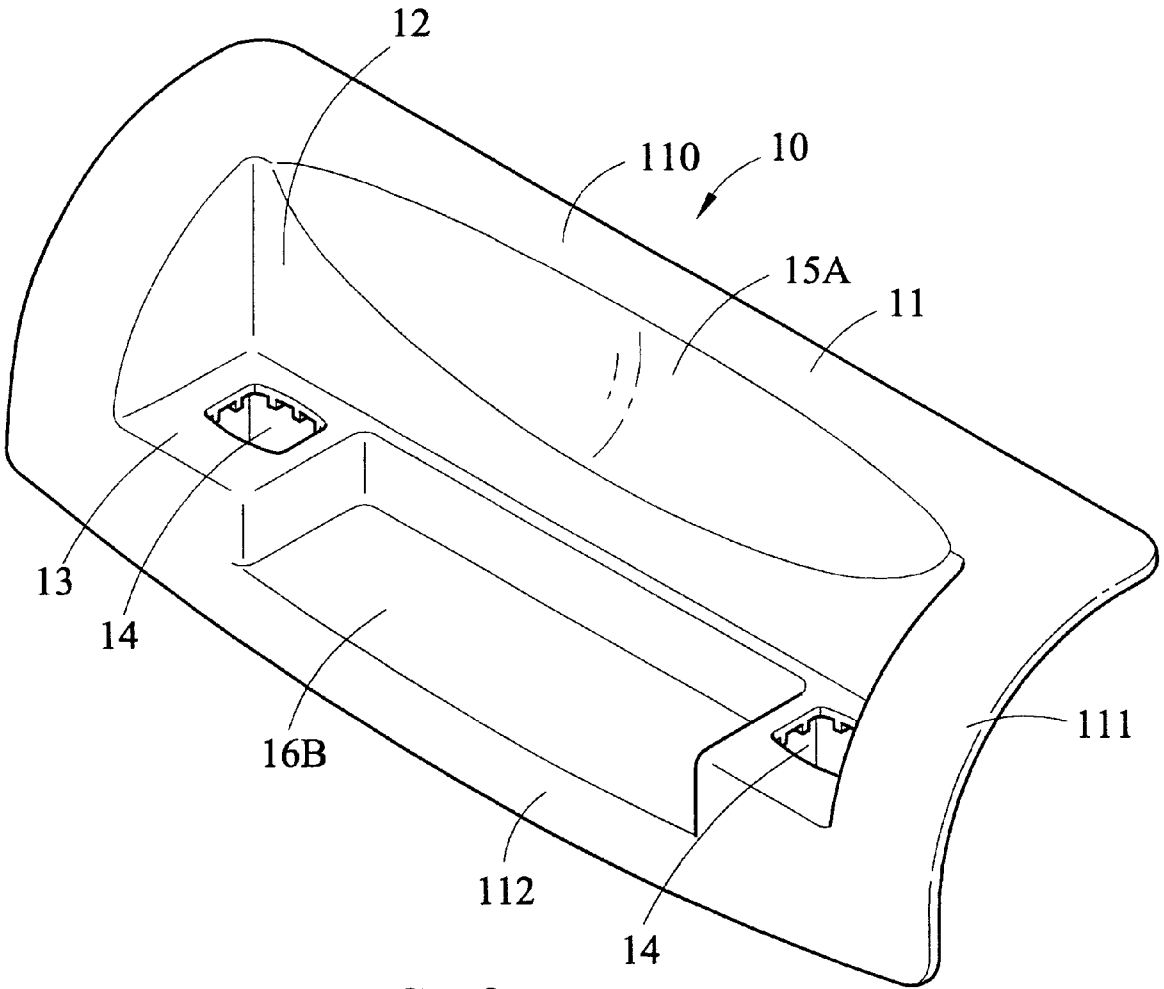
FIG. 6 is a perspective view of a third preferred embodiment of bezel of luggage according to the invention.

Referring to FIG. 5, according to the second embodiment of the invention, the shapes of recesses 15A and 16A may be varied. For example, recesses both are smoothly concave but sizes different. Alternatively, as shown in FIG. 6, according to the third embodiment of the invention, second recess 15A is of a smoothly concave shape, while the first recess 16B is substantially of a parallelepiped for the purpose of further increasing a receiving space for hand to insert into the bezel.

While the invention herein disclosed has been described by means of specific embodiments, numerous modifications and variations could be made thereto by those skilled in the art without departing from the scope and spirit of the invention set forth in the claims.

What is claimed is:

1. A bezel on a top rear portion of a wheeled luggage having two handle rods and a top handle grip, the bezel comprising:

a) a body having a front upper side; a rear lower side; two arcuate sides joining the front upper side and the rear lower side; a horizontal portion and a vertical portion extending from the rear lower side and the front upper side, respectively; and two spaced tunnels accommodating the two handle rods;

b) a first recess at a juncture of the horizontal portion and the rear lower side; and c) a second recess at a junction of the front upper side and the vertical portion, the second recess having a surface oriented obliquely to the front upper side and the vertical portion.

2. The bezel on the top rear portion of the wheeled luggage according to claim 1, wherein the first recess has a surface oriented obliquely to the horizontal portion and to the rear lower side.

3. The bezel on the top rear portion of the wheeled luggage according to claim 2, wherein the surface of the first recess and the surface of the second recess each have a concavely curved cross-sectional configuration.

4. The bezel on the top rear portion of the wheeled luggage according to claim 1, wherein the first recess has a parallelepiped shape and the surface of the second recess has a concavely curved cross-sectional configuration.

* * * * *